US005307544A

United States Patent [19]

Quarberg et al.

[11] Patent Number: 5,307,544

[45] Date of Patent: May 3, 1994

[54] SEAT BELT BUCKLE GUARD

[75] Inventors: Craig D. Quarberg, 6908 Candlewood Cir., Brooklyn Park, Minn. 55445; Patrick J. McNaughton, Brooklyn Park, Minn.

[73] Assignee: Craig D. Quarberg, Brooklyn Prk, Minn.

[21] Appl. No.: 906,335

[22] Filed: Jun. 30, 1992

Related U.S. Application Data

[63] Continuation-in-part of Ser. No. 817,393, Jan. 6, 1992, abandoned.

[51] Int. Cl.[5] ..... A44B 11/26

[52] U.S. Cl. ..... 24/633; 24/573.1

[58] Field of Search ..... 24/633, 573.1, 573.5; 297/468

[56] References Cited

U.S. PATENT DOCUMENTS

| | | | |
|---|---|---|---|
| 4,497,094 | 2/1985 | Morris | 24/633 |
| 4,624,033 | 11/1986 | Orton | 24/633 |
| 4,675,954 | 6/1987 | Gullickson . | |
| 4,731,912 | 3/1988 | Boriskie et al. . | |
| 4,878,277 | 11/1989 | Portuese | 24/633 |
| 4,939,824 | 7/1990 | Reed . | |
| 4,961,251 | 10/1990 | Smith . | |
| 4,987,662 | 1/1991 | Haffey et al. . | |
| 5,052,087 | 10/1991 | Portuese . | |

FOREIGN PATENT DOCUMENTS

WO84/01275 4/1984 PCT Int'l Appl. ..... 24/633

*Primary Examiner*—James R. Brittain

*Attorney, Agent, or Firm*—Haugen and Nikolai

[57] ABSTRACT

A seat belt buckle guard comprises a one-piece, molded plastic, box-like enclosure having one open end and an opposite end wall with a slot. The seat belt buckle fits through the open end into the enclosure with its latch plate receiving slot aligned with the slot in the housing. The latch plate on one belt half can be inserted through the housing slot to make with the buckle. Formed in the top wall and the end wall is an opening for gaining access to the buckle release button. In one arrangement, the opening is a narrow slot through which a flat object, such as a key, can be inserted to operate the buckle's release button. In accordance with an alternative embodiment, the opening is a circular aperture of a size permitting one's finger to be inserted to operate the release button. The opening is surrounded by a tubular stub or neck threaded on its exterior to receive a child-resistant safety cap of the type commonly used on medicine bottles. When the cap is removed, a finger can be inserted to activate a release button or the unit can be separated by folding along the hinge to allow actuation of a lever-type release or to gain access to a release button disposed on a front end edge of the buckle receptacle.

10 Claims, 3 Drawing Sheets

SEAT BELT BUCKLE GUARD

CROSS-REFERENCE TO RELATED APPLICATION

This application is a continuation-in-part application of Ser. No. 07/817,393, filed Jan. 6, 1992, abandoned and entitled "SEAT BELT BUCKLE GUARD".

BACKGROUND OF THE INVENTION

I. Field of the Invention

This invention relates generally to seat belts of the type used in motor vehicles and aircraft, and more particularly to a device to be used with such seat belts for preventing the uncoupling or release thereof by small children and/or the unintended or inadvertent release of seat belts by adults.

II. Discussion of the Prior Art

Almost all states now require passenger automobiles, school buses and perhaps other vehicles to be equipped with passenger seat belts for restraining the occupants of such vehicles in the event of accidents. Similarly, all aircraft includes seat belts to prevent sudden turbulence or the like from throwing the passenger from his/her seat. Seat belts of the type concerned here generally comprise a pair of nylon webs or straps which are anchored at one end to the frame of the vehicle. The other end of one of the straps has a seat belt buckle having a release button or release lever mounted thereon and a female slot for receiving a latch plate secured to the free end of the other strap. A latching mechanism is incorporated within the buckle for locking the latch plate within the buckle, the release button, when depressed, or the release lever, when lifted, allowing the two parts to be separated.

It has been found that when young children are restrained in a vehicle seat by means of a seat belt of the type described, at a relatively young age, they are able to master the operation of the release button/lever and can often do so without the knowledge of the adult driver. This can be extremely dangerous in the event of an accident.

It can also happen that an adult may inadvertently or unwittingly depress the buckle release button, allowing the belt halves to uncouple.

It is therefore a principal object of my invention to provide an improved guard mechanism for preventing small children from releasing their vehicle seat belt and for inhibiting any unintended release of the seat belt by older persons. We are not the first to address this particular problem. The patent art describes various types of seat belt buckle guards for performing the same function. For example, the Boriskie Pat. No. 4,731,912 describes a seat belt buckle guard in the form of a box-like device having first and second housing portions which are hinged together allowing the seat belt buckle with the release mechanism thereon to be inserted into a first box-like housing and then have the second part of the housing snapped closed about the buckle. The top of the second box is sufficiently rigid that it cannot be depressed to the point where the release button of the seat belt can be actuated. Small children can soon master the act of opening the hinged cover of the box and can then depress the buckle release button.

The Reed Pat. No. 4,939,824 describes yet another vehicle safety belt buckle cover in the form of a generally rectangular shaped covering member which substantially overlays the surface of the buckle and its release button. The cover is held closed relative to the buckle by means of a strap. This design also suffers from the defect that in only a short time, a child can readily effectively remove the buckle guard to gain access to the buckle's release mechanism.

Still other patents describing seat belt buckle guards are Portuese 5,052,087, Haffey 4,987,662, Smith 4,961,251 and Gullickson 4,675,954.

SUMMARY OF THE INVENTION

Our invention is deemed to be an improvement over the prior art devices referred to above. In accordance with a first embodiment, once the seat belt buckle guard is in place over the locked buckle assembly, a special tool, such as a key, a coin, a credit card or some other thin flat instrument, must be used to actuate the release button to allow the belt halves to be separated. Automobile keys or similar items would typically be on the person of an adult at all times when operating a motor vehicle. Small children would not typically have access to such items. Moreover, because the depression of the release button by an adult requires the conscious act of inserting the tool through an opening in the guard, it is highly unlikely that the belt halves would separate unintentionally.

In accordance with the first embodiment mentioned, the seat belt buckle guard comprises a hollow, rectangular box-like enclosure having a top wall, a bottom wall, two side walls and only one end wall, one of said top wall and end wall having an opening of a predetermined shape formed through the thickness thereof midway between the two side walls. The opening is aligned with the release button of the seat belt when the female buckle receptacle is disposed within the hollow enclosure. A slot is formed through the thickness dimension of the one end wall of the guard and it extends perpendicular to the two side walls. The slot is dimensioned to receive the male latch plate of the seat belt assembly therethrough so that it can be inserted into the buckle and latched in place. To again separate the belt halves, the wearer or another person must insert a thin flat object, such as a vehicle key, through the opening in the buckle guard and must push that implement against the release button to unlatch the latch plate relative to the buckle. It is not designed to be used with seat belt buckles of the lever-release type.

In a second embodiment, a so-called "child-resistant" safety cap of the type commonly used on medicine bottles covers an opening in the buckle guard. By removing the cap, a person can insert a finger through the opening to actuate the release button.

In the third embodiment, rather than having a narrow slot as the access through the enclosure to the release button, the enclosure has an opening surrounded by a tubular neck on which a child-resistant safety cap can be attached. For facilitating it with a variety of seat belt buckle types, it has been found expedient to divide it along a parting line that passes medially through the threaded tubular neck, the top surface from which the neck projects and through the opposed end walls. A living hinge or any other type of hinge may join the members together along a medial line in the bottom surface of the enclosure. When the segments are folded together about the seat belt buckle, integrally formed alignment pins on one half mate with bores formed on the other half to hold the halves together and in proper registration. The cap on the neck further prevents the halves from separating. A variety of child-resistant cap designs may be employed. If a "push and turn" type is used, removal of the cap requires a simultaneously applied downward and turning force. Other types include "pull and turn", "squeeze and turn" and "arrow alignment". Children under the age of eight generally cannot perform these operations. Once removed, the enclosure can be spread open, allowing both button and lever type releases to be operated.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
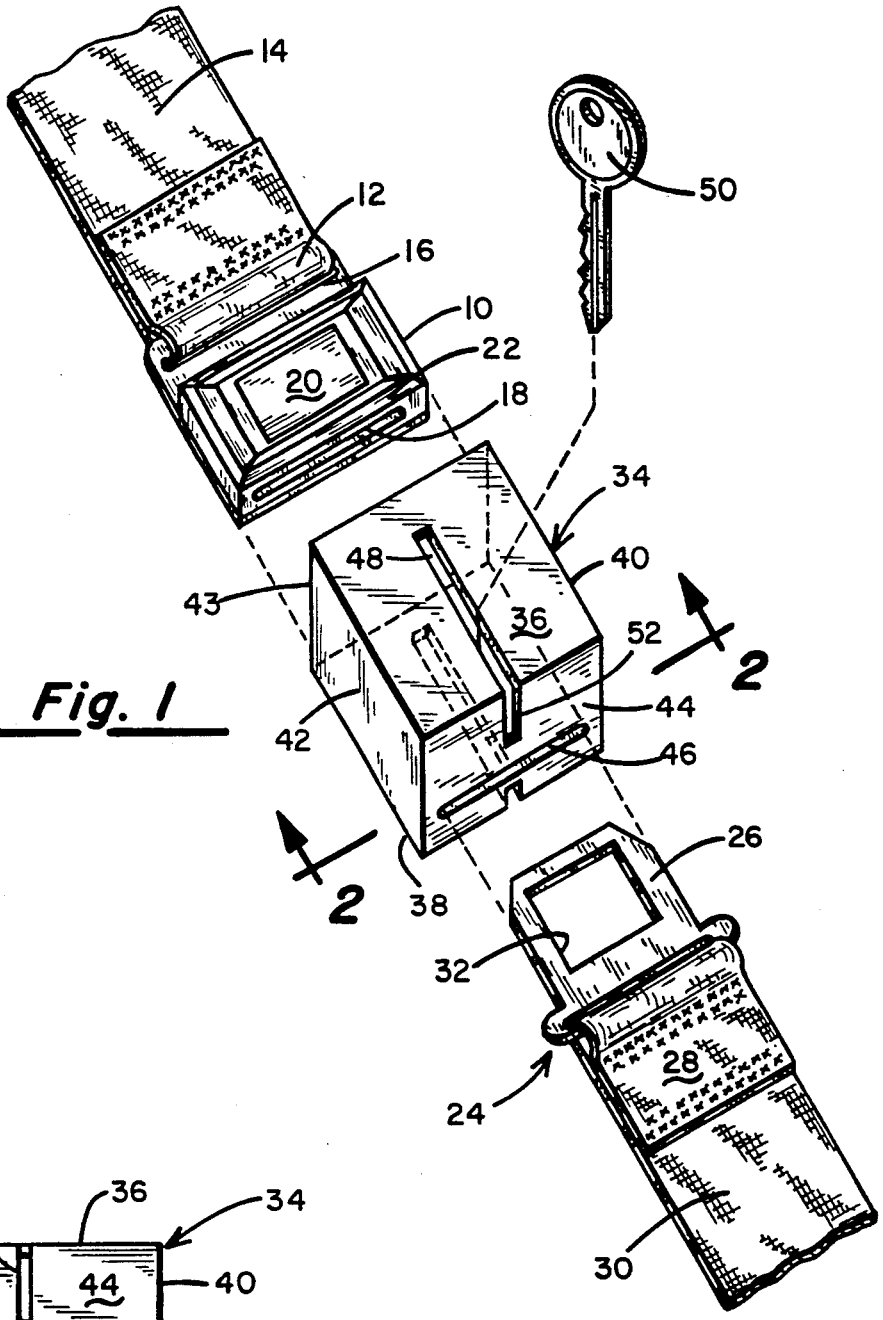
FIG. 1 is a perspective, exploded view illustrating the principles of the first embodiment of the present invention.

Referring first to FIG. 1, there is indicated by numeral 10 a conventional seat belt buckle affixed to the free end portion 12 of a seat belt 14. In particular, the web of the belt 14 passes through a slot 16 formed in the buckle 10 and then bent back to overlay itself. The end portion 12 of the belt 14 is then stitched or otherwise bonded so as to permanently attach the buckle 10 to the belt. The buckle 10 includes a latch plate receiving slot 18 formed in the front edge of the buckle and disposed atop the buckle is a release button 20.

While the release button 20 is shown as being located on the top face of the buckle 10, it is quite common to find seat belt buckles having the release button built into the front or leading edge surface 22 of the buckle. The embodiment of FIG. 1 is designed to work with either type, but not with the lever style of buckle release.

The other half of the seat belt assembly is indicated by numeral 24 and is seen to include a latch plate 26 fastened to the free end 28 of a second seat belt half 30. The mechanism within the buckle 22 is such that when the latch plate 26 is inserted into the slot 18 in the buckle, a latch member internal to the buckle snaps through the opening 32 in the latch plate preventing the parts from being separated unless and until the release button 20 is depressed.

The details of the seat belt thus far described are altogether conventional. The present invention resides in the seat belt buckle guard indicated generally by numeral 34. The guard is preferably molded from a rigid, tough plastic, such as that sold under the trademark, DELRON. Other plastics, of course, may be used as well. The guard 34 comprises a generally rectangular, box-like enclosure having a top wall 36, a bottom wall 38, two side walls 40 and 42 and one end wall 44. The opposite end of the enclosure is open as can be seen from the end view of FIG. 2.

The end wall 44 includes a transversely extending, narrow slot 46 formed through the thickness dimension thereof and it extends generally perpendicular to the two side walls 40 and 42. The slot 46 is dimensioned to permit the latch plate 26 of the seat belt half 24 to be inserted through it so as to mate with the slot 18 formed in the buckle 10 when that buckle is inserted through the open end of the guard 34.

The top wall 36 has an elongated narrow slot formed through its thickness dimension as at 48 and it is generally midway disposed relative to the two sides 40 and 42 to thereby overlay the release button 20 when the buckle halves 24 and 10 are joined together within the enclosure defined by the buckle guard 34.

To release the buckle halves from one another, a person must insert a thin, narrow instrument through the slot 48 and press it against the release button 20 with sufficient force to effect release of the buckle halves. For automotive seat belts, a key such as at 50 is a convenient device to use as the tool or instrument in question. In that a small child typically would not have available to him an instrument of this type, the child would not be in a position to release the belt.

Figure 2:
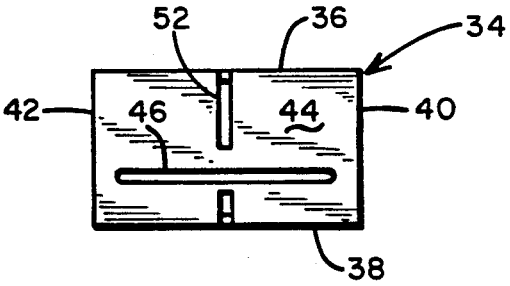
FIG. 2 is an end view of the seat belt buckle guard shown in FIG. 1.

With further attention to the drawings of FIGS. 1 and 2, to accommodate those seat belts where the release button is positioned on the end surface 22 of the buckle, a further slot 52 may be formed in the end wall 44 so as to intersect with the slot 48 in the top wall 36. It is preferable that the slot 52 not intersect the transversely extending slot 46 because that could weaken the structural integrity of the guard device 34.

While not altogether necessary, it has also been found expedient to include a mirror image of the slots 48 and 52 in the bottom surface 38 and the front wall 44 of the guard device so that the guard will not inadvertently be installed upside down with an otherwise unslotted bottom wall overlaying the release button 20. That is to say, irrespective of whether the buckle 10 is inserted into the guard device 34 when positioned as shown in FIG. 1 or instead with the wall 38 directed upward, access can always be gained to the release button by the key 50 or similar instruments.

Figure 3:
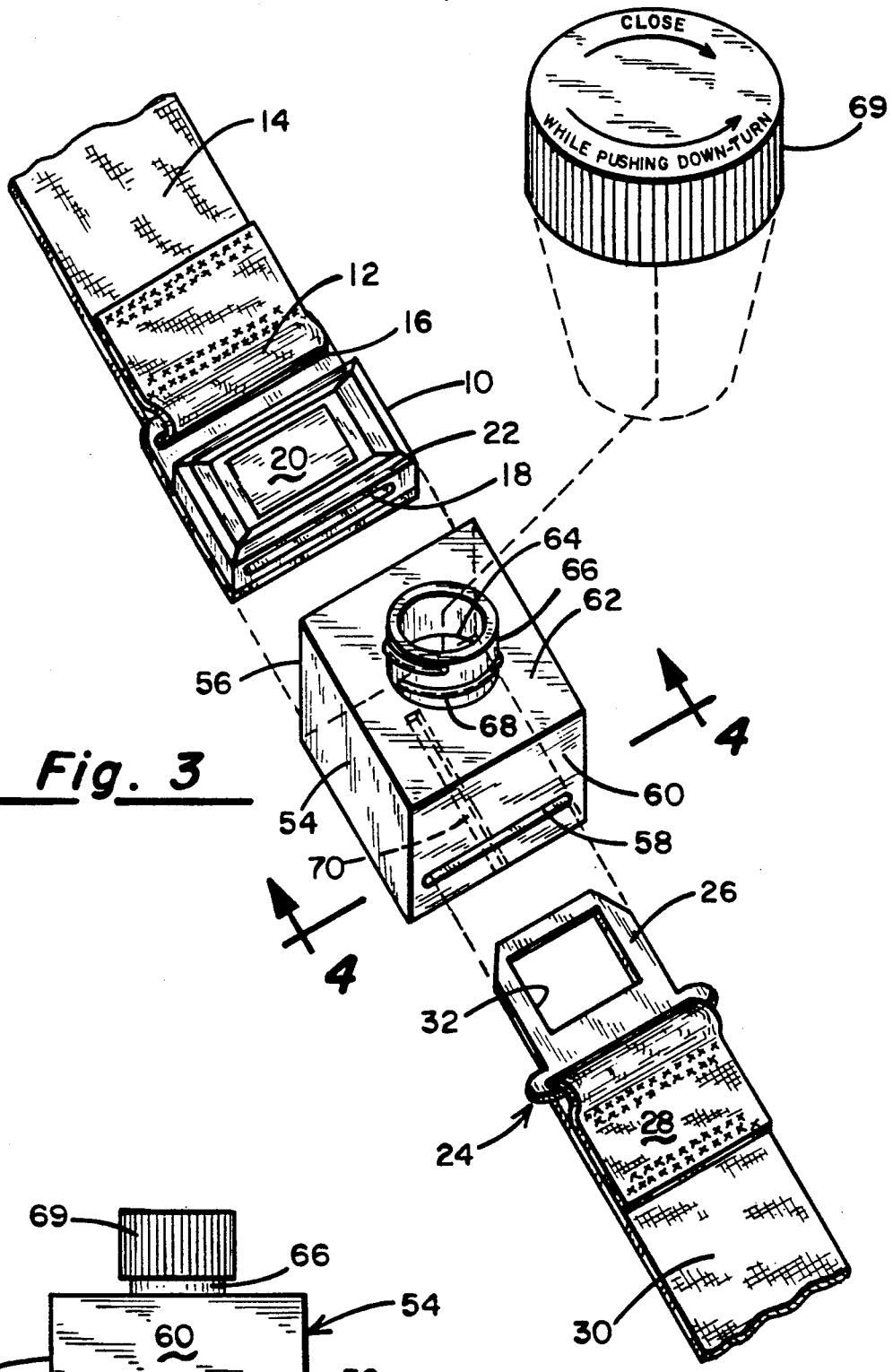
FIG. 3 is a perspective exploded view illustrating the principles of the second embodiment of the present invention.

The second embodiment of the present invention illustrated in FIG. 3 is somewhat similar to the earlier described embodiment in that it includes a box-like housing 54 having one open end 56 for accommodating the insertion of the buckle 10 of one-half of the seat belt as well as a horizontally extending slot 58 formed in the otherwise closed end 60 of the enclosure. Rather than including a narrow elongated slot in the top surface 62 of the enclosure 54 as in the embodiment of FIG. 1, instead a circular or other shaped opening 64 is formed therethrough and surrounding this opening is a tubular neck member 66 which may or may not have threads 68 formed thereon, depending upon the type of child-resistant closure employed. The drawing shows a "push and turn" ratchet-type, child-resistant safety cap 69 of the type used as closures for medicine bottles and the like. When the cap 69 is in place on the neck 66, access to the release button 20 of the seat belt buckle is precluded. To remove the cap 69, it is necessary to simultaneously push down on the cap while turning it in the counterclockwise direction. While an adult can readily perform this maneuver, most children under the age of about eight years find it difficult or impossible.

Should the user of the buckle guard of FIG. 3 inadvertently apply it to the buckle 10 upside down from what is shown in FIG. 3, by including the slot 70 in the bottom surface thereof, access can be had to the release button using a key, coin or other narrow devices readily available so that it can be inverted and properly positioned on the buckle.

Figure 4:
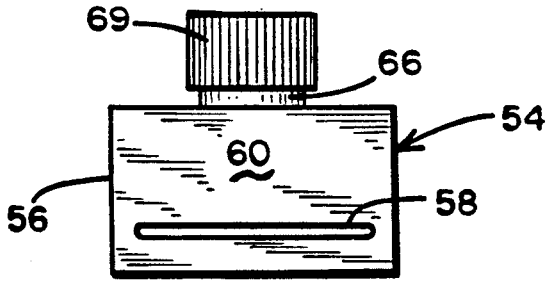
FIG. 4 is an end view of the device of FIG. 3.
Figure 5:
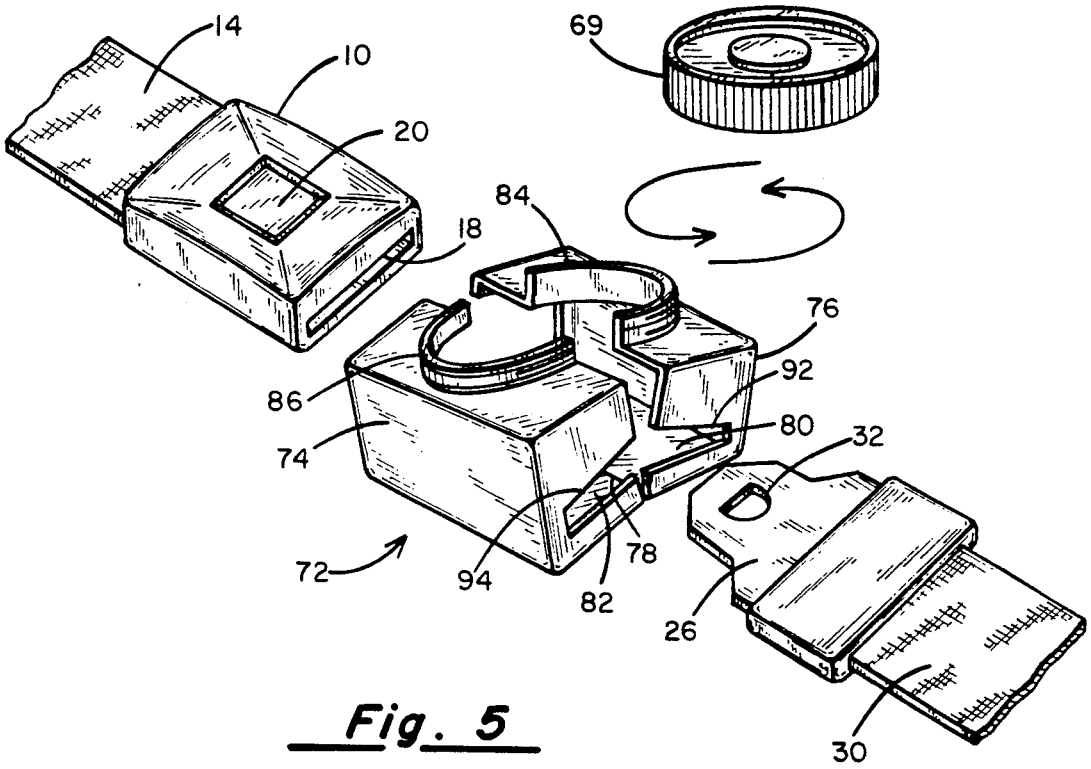
FIG. 5 is a perspective view of a further embodiment.

FIG. 5 is a perspective view of an alternative way of constructing the seat belt buckle guard of the present invention. It is similar in its concept to the embodiment illustrated in FIGS. 3 and 4 in that it incorporates a "child-resistant cap" which must be removed to gain access to the seat belt buckle's release button. It differs from the embodiment of FIGS. 3 and 4, however, in that it has an enclosure indicated generally by numeral 72 comprised of first and second halves 74 and 76 which are joined by a hinge 78 or other suitable hinge serving to couple the bottom surfaces 80 and 82 together along a median line. When the halves 74 and 76 are brought together with the semi-circular segments 84 and 86 abutting one another to form a cylindrical tubular neck, a child-resistant cap, such as is indicated by numeral 69, can be screwed onto the neck, thus holding the enclosure 72 in its box-like configuration about the seat belt buckle 10 which is insertable through the opening defined by U-shaped slots (not shown) formed in the end walls of the guard halves 74 and 76. Likewise, the male buckle member 26 may pass through the opening resulting when the slots 92 and 94 are brought together as the two halves are folded relative to the hinge 78.

Because the box-like enclosure can be spread open once the cap 69 is removed, the embodiment of FIG. 5 is usable with a seat belt having a lever-style release mechanism as well as with top button and front button style releases.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. An article of manufacture comprising a hollow rectangular box-like enclosure having a top wall, a bottom wall, two side walls and only one end wall, said top wall having an opening formed through the thickness dimension thereof midway between said two side walls, said one end wall including a transversely extending narrow slot formed through the thickness dimension thereof and extending perpendicular to said two side walls, said opening in said top wall being an elongated narrow slot extending inward from said one end wall and with a further slot in said one end wall extending perpendicular to said transversely extending slot and intersecting said slot formed through said top wall.

2. The article as in claim 1 and further including an elongated narrow slot formed through the thickness dimension of said bottom wall and extending parallel to said slot in said top wall and extending from said one end wall.

3. The article as in claim 1 wherein said hollow, rectangular, box-like enclosure is dimensioned to receive the female receptacle of a seat belt buckle through the end opposite said one end wall and the male clasp of said seat belt buckle through said transversely extending slot.

4. In combination with a vehicle seat belt of the type having a webbed strap with a male clasp at one end and a female buckle receptacle at the other end, said female buckle receptacle having a release mechanism thereon, an enclosure for inhibiting unintended release of said male clasp from said female buckle receptacle comprising:

(a) a hollow rectangular box-like enclosure having a top wall, a bottom wall, two side walls and only one end wall, one of said top wall and end wall having a slot formed through the thickness dimension thereof and a contiguous intersecting slot formed through the thickness dimension of said one end wall midway between said two side walls, said slot formed through said top wall and said intersecting slot formed through the thickness dimension of said one end wall being aligned with said release mechanism when said female buckle receptacle is disposed within said hollow enclosure, and a further slot formed through the thickness dimension of said one end wall and extending perpendicular to said two side walls, said further slot for receiving said male clasp therethrough, said slot formed through one of said top wall and said one end wall dimensioned to receive a rigid implement therethrough for depressing said release button.

5. The combination as in claim 4 and further including a slot formed through the thickness dimension of said bottom wall symmetrically disposed relative to said slot formed through said top wall.

6. The combination as in claim 4 and further including a slot formed through the thickness dimension of said bottom wall and a contiguous intersecting slot formed through the thickness dimension of said one end wall symmetrically disposed relative to said slot formed through said top wall.

7. The combination as in either of claims 1 or 4 wherein said hollow box-like enclosure is a single piece made of plastic.

8. In combination with a vehicle seat belt to the type having a webbed strap with a male clasp at one end and a female buckle receptacle at the other end, said female buckle receptacle having a release mechanism thereon, an enclosure for inhibiting unintended release of said male clasp from said female buckle receptacle, comprising:

(a) first and second integrally molded plastic housing members, each having a top surface, a bottom surface and an end surface and first and second side surfaces;

(b) a hinge joining said bottom surfaces of said first and second housing members together;

(c) a semi-circular opening formed through said top surface of each of said first and second housing members;

(d) a semi-circular neck projecting perpendicular to said top surface and including a pattern of threads on said exterior surface of said neck, said semi-circular openings and said necks positioned so that when said first and second members are folded together about said hinge, a circular opening and a tubular neck results;

(e) U-shaped slots formed through said first and second side surfaces of said first and second housing members and positioned so that when said first and second members are folded together about said hinge, said U-shaped slots in the first member cooperates with the corresponding U-shaped slot in the second member to form two elongated slots, one in each of said first and second side surfaces, the elongated slot in said first side surfaces receiving said female buckle receptacle therethrough and the elongated slot in said second side surfaces receiving said male clasp therethrough; and (f) a threaded cap removably secured to said tubular neck.

9. The enclosure as in claim 8 and further including mating alignment elements integrally formed on said semi-circular necks for aligning said plastic housing members so that the threads on a semi-circular neck on one member are aligned with the threads on the semi-circular neck of the other member.

10. The enclosure as in claim 8 wherein said circular opening is generally aligned with said release mechanism of said buckle when said female buckle receptacle is inserted through said elongated slot in said first side surface of said housing.

* * * * *